United States Patent [19]

Ganz

[11] Patent Number: 4,488,492

[45] Date of Patent: Dec. 18, 1984

[54] RAILWAY TRACK TAMPING MACHINE

[75] Inventor: Jorg Ganz, Etoy, Switzerland

[73] Assignee: Sig. Societe Industrielle Suisse, Chutes du Rhin, Switzerland

[21] Appl. No.: 352,371

[22] Filed: Feb. 25, 1982

[30] Foreign Application Priority Data

Mar. 2, 1981 [CH] Switzerland ..... 1378/81

[51] Int. Cl.[3] ..... E01B 27/16

[52] U.S. Cl. ..... 104/12; 37/105; 172/4; 104/10

[58] Field of Search ..... 104/7 R, 7 B, 10, 12; 172/2, 4, 4.5; 37/DIG. 1, 104, 105

[56] References Cited

U.S. PATENT DOCUMENTS

| | | | |
|---|---|---|---|
| 3,653,327 | 4/1972 | Sauterel | 104/12 |
| 4,044,838 | 8/1977 | Wooldridge | 172/2 |
| 4,157,118 | 6/1979 | Suganami et al. | 172/4.5 |
| 4,312,275 | 1/1982 | Theurer et al. | 104/12 |

FOREIGN PATENT DOCUMENTS

| | | | |
|---|---|---|---|
| 1427383 | 12/1965 | France | 172/2 |
| 614475 | 11/1979 | Switzerland | 104/12 |
| 643106 | 1/1979 | U.S.S.R. | 172/2 |

*Primary Examiner*—Randolph Reese

*Attorney, Agent, or Firm*—Anthony J. Casella; Gerald E. Hespos

[57] ABSTRACT

Each tamping unit of the tamping machine has a gantry (6) which is inclinable transversely to the track and in which the tool holder (3) is mounted for vertical movement.

The amplitude of the downward movement of the tool holder (3) is regulated by a device (16 to 21) controlled by a command level corresponding to the depth of tamping desired.

In order to correct the differences (E) between the depth of tamping reached and that desired which are caused by the inlination of the gantry (6), the command level is lowered by a distance substantially equal to the differences by a correction device comprising a mechanical feeler (25) for detecting the inclination of the gantry (6) and a mechanical connection (26, 34) connecting the said feeler to the sensitive member (16) of the regulating device in order to vary the zero thereof.

In a variant, this correction device is formed of an electronic circuit which permits the cancelling of the differences (E).

2 Claims, 7 Drawing Figures

RAILWAY TRACK TAMPING MACHINE

The object of the present invention is a railway track tamping machine whose rolling chassis has at least one tamping unit equipped with at least two oscillating and pivoting tools articulated, in opposition, on a tool holder mounted for vertical movement in a gantry which is inclinable at least in one plane transverse to the track in order to permit the tamping of the track switches, and a device for regulating the amplitude of the descending movement of the tool holder in the gantry, adapted to give off a switch signal causing the stopping and/or reversal of the said movement at a command level established as a function of the desired depth of penetration of the tools in the ballast.

On the known tamping machines of this type, the device for regulating the amplitude of the descent of the tool holder is useful in order to permit adaptation to changes in track equipment so as to assure in all cases an optimal depth of tamping, regardless of the variations in the height of the rails and of ties. On some of these known tamping machines this regulating device consists of inductive or capacitive electro-mechanical end-of-stroke devices, with all-or-nothing control effected by adjustable cams. On other more recent known tamping machines, described in Swiss Patent No. 614,475, this regulating device is formed of an electronic circuit comprising a displacement detector which gives off information as to the level reached by the tool holder, of a comparator set to a command level for producing the switch signal upon arrival of the tool holder at the said level and of an apparatus for setting the command level in question.

During the tamping of track switches, the transverse inclination of the gantry of the tamping units of these machines makes it possible to move the tools from the two rows of rail followed in order to avoid lateral obstacles which prevent their insertion in the ballast and consist, for instance, of the check rails and the points of the crossings. This transverse inclination of the gantry has the effect of displacing the tamping tools along a circular path the center of which is formed by the articulation of the gantry on the chassis of the tamping machine. This has the result that, upon going away from the plumb line of this articulation, which is generally located substantially above a line of rail, the tools rise again with respect to the plane of rest of the ties of the track by an amount which is greater the greater the inclination of the gantry. The depth of tamping, regulated by the aforementioned regulating device, is thus falsified by a variable value which is difficult to control due to the absence of reference to the plane of the track.

In order to avoid irregular tamping as a result of the rising of the tools, the operator has the possibility of modifying the amplitude of the movement of descent of the tamping tools by acting each time on the device regulating this amplitude. However, this additional requirement is difficult and fastidious, can be checked only by the naked eye, and most of the time is neglected by the operator who is already too involved with the maneuvers of avoiding obstacles of the track gear and who, in the face of increasingly great demands for output, no longer takes the time for this.

In order to minimize the differences in tamping depth resulting from the inclination of the tamping units without requiring intervention on the part of the operator, the solutions provided up to now have consisted in raising to the maximum, insofar as possible, the level of the articulation of the gantry for the tamping units in order to increase the radius of curvature of the trajectory of the tools and in combining, on certain recent tamping machines, the transverse inclination of the gantry with a translation—also transverse—of its articulation with respect to the chassis of the tamping machine and by means of a necessary connecting mechanism between these two movements. This latter solution, combining inclination and translation, is satisfied, since for a given lateral distance between the tools, the inclination of the gantry is less, a part of the combined displacement being obtained by a translation of its articulation, and the difference in depth is thereby decreased. For the same tolerance in difference in tamping depth, this gain can be utilized to increase the lateral reach of the tools and thus tamp further below the long ties of crossings.

For this same purpose of automatically reducing differences in tamping depth resulting from the transverse inclination of the tamping units of all the aforementioned tamping machines, the invention proposes, based on a different concept, a means of obtaining in these tamping machines, an additional reduction of the said differences, going possibly as far as their cancellation.

For this purpose, the tamping machine of the invention is characterized by the fact that it comprises a device for the correction of the differences between the depth of penetration reached and that desired on the part of the tools, caused by the transverse inclination of the gantry upon the tamping of the track switches, and by the fact that this correction device comprises a member for detecting the angular displacement of the gantry with respect to the chassis and capable of producing a correction signal as a function of said angular displacement which is representative of at least a part of the difference in depth of penetration which it causes, and a connection for transmitting the said correction signal, established between said detection member and the device for regulating the amplitude of the descending movement of the tool holder and adapted to lower the command level for the issuance of the switch signal by a distance corresponding to that represented by the said correction signal.

In this way, by the selection of the function relating to the angular displacement of the gantry of the tamping units to the difference in tamping depth which results therefrom, it is possible to reduce this difference to the desired proportions and even to cancel it out.

The accompanying drawing shows, by way of example, two embodiments of the object of the invention.

Figures 1, 2, 3, 4, 5:
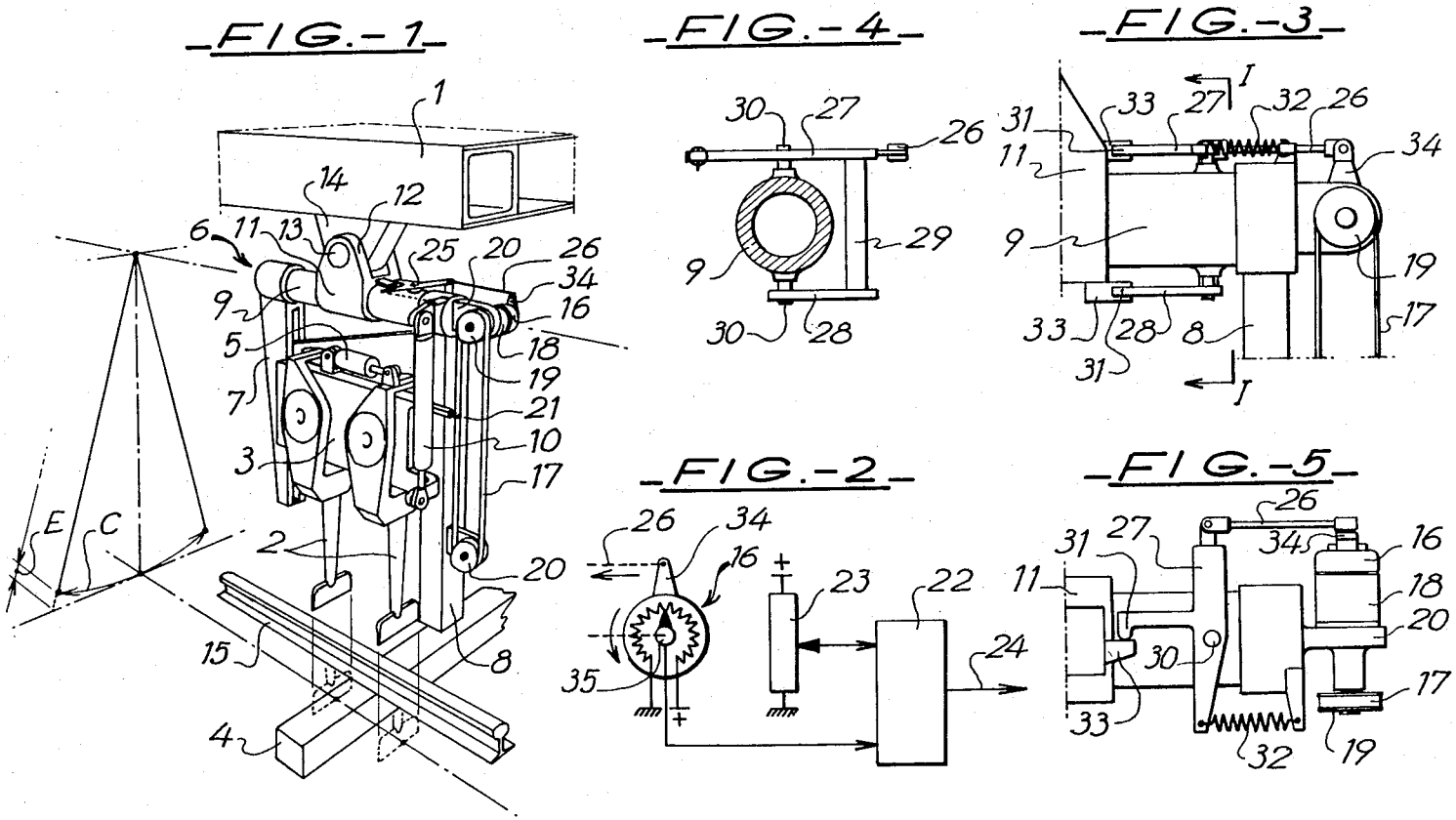
FIG. 1 is a partial view in perspective of the first embodiment.
FIG. 2 is a block diagram referring thereto.
FIG. 3 is a front view on a large scale of a detail of FIG. 1.
FIG. 4 is a section view of this detail, along the line I—I of FIG. 3.
FIG. 5 is a top view thereof.

In FIG. 1, there is shown a tamping unit of the first embodiment of the tamping machine of which there is shown only a part of its rolling chassis 1.

The tamping unit is of the type having two oscillating pivoting tools 2 in the form of a lever extended by a pick, which are articulated and arranged in opposition on a tool holder 3 in the form of a housing containing the mechanism for the oscillating of these tools. The pivoting of the tools, intended to assure the closing of their picks around each tie 4 of the track, is obtained by two hydraulic cylinder-piston units 5, only one of which is shown, resting against the tool holder 3.

The tool holder 3 is mounted for vertical movement in a gantry 6 formed of two uprights 7 and 8 connected by an upper cylindrical cross-member 9. This tool holder 3 slides along slideways borne by the two uprights 7 and 8 which surround it and its movements of descent and ascent are obtained by a hydraulic cylinder-piston unit 10 resting on the end of the upright 8.

The gantry 6 is connected to the chassis 1 by a suspension system comprising a bearing 11 in which there is rotatably mounted the cylindrical cross-member 9 and on the top of which there is a yoke 12 articulated on a trunnion 13 borne by a bracket 14 fastened to the said chassis substantially directly above a line of rails 15 of the track. This suspension imparts the tamping unit a pendulum mobility both in a plane transverse to the track by pivoting in the bearing 11 and in a plane parallel to the track by pivoting around the trunnion 13 of the bracket 14. It is intended to permit the transverse and longitudinal avoidance of obstacles created by the track gear and passage from one side to the other of the line of rails 15 and for this purpose has an animating device consisting of arm and cylinder-piston unit connecting the cross member 9 to the chassis 1, which has not been shown in order not to needlessly clutter the drawing.

The hydraulic control circuit of the cylinder-piston unit 10 for the driving of the tool holder 3, which has not been shown for the same reason, is connected to a device for regulating the amplitude of the movement of descent of the said tool holder which is adapted to give off a switch signal which controls the stopping and/or reversing of this movement at a command level established as a function of the desired depth of penetration of the tools 2 into the ballast.

This regulating device is formed here of a rotary detector 16 driven by the vertical displacements of the tool holder 3 via a notched-belt transmission 17 and of a circuit for the processing of the signals of the said detector represented by the block diagram of FIG. 2 and intended to produce the said switch signal.

The detector 16 is in this case a single revolution rotary potentiometer the wiper of which is driven, via a coaxial reducer 18, by a notched pulley 19. This assembly is borne by a bracket 20 fastened to the end of the cross-member of the gantry 6.

The notched belt 17 is stretched parallel to the upright 8 of the gantry between the notched pulley 19 and a return pulley 20 and is driven by the tool holder 3, to which it is connected for this purpose by a drive finger 21 fastened to the said tool holder. In this way, the rotary potentiometer 16 permanently supplies an electrical information indicative of the level reached by the tool holder 3 in the gantry 6.

This electrical information is transmitted by cable to the regulating circuit shown in FIG. 2 in combination with the detector 16. This circuit, installed in the control desk of the cab of the tamping machine for instance, comprises a comparator 22 set to the aforementioned command level in order to produce the switch signal controlling the stopping and/or reversing of the downward movement of the tool holder 3 and an apparatus for setting the command level in question, which in this case is a regulating potentiometer 23. The comparator 22 is connected by a cable 24 to the control circuit of the cylinder-piston unit 10 in order to transmit the switch signal thus produced.

For each command level regulated by the potentiometer 23, the depth of penetration reached by the tamping tools 2 in the ballast, represented in dot-dash lines in FIG. 1, varies as a function of the transverse inclination of the gantry 6 and, as already explained previously, of a variable difference E which itself is a function of the degree of curvature of the path C of the end of these tools.

The tamping machine has a device for the correction of the difference E and this device comprises, in this first embodiment and in accordance with the teaching of the invention, a member for detecting the angular displacement of the gantry 6 with respect to the frame 1 and a connection established between said detection member and the said device for regulating the amplitude of the movement of descent of the tool holder 3 in the said gantry 6.

The detection member is in this case a mechanical feeler 25 (FIG. 1) with switchback position, shown in large scale and in detail in FIGS. 3, 4, and 5 formed of a double rocker lever each of the two elements 27 and 28 of which has two square angle arms the said elements being connected rigidly by a spacing cross member 29. This rocker lever is articulated in the region of the encounter of its arms, in the manner of a stirrup (FIG. 4), on two coaxial pivots 30 borne by the cylindrical cross-member 9 of the gantry 6. The common axis of these two pivots 30 is perpendicular to that of the cross member 9. One of the two square angle arms of the two elements 27 and 28 has a rounded end tab 31 (FIG. 5) while the cross member 29 connects the other two arms of these two elements. The contact points of the two tabs 31 are inscribed in a plane containing the common axis of the two pivots 30. These two tabs 31 are pressed elastically by a spring 32 against two stops 33, arranged symmetrically with respect to the axis of the cylindrical cross member 9 on the bearing 11, the element of reference to the chassis 1, in which the said cross member is rotatably mounted, and the bearing face of these two stops 33 is also contained in the said plane in the position shown, which corresponds both to the perpendicularity of the gantry 6 with respect to the plane of the track followed by the machine and the switchback of the said feeler.

The connection 26 is formed of a rod connecting the element 27 of said feeler to a lever 34 fastened to the housing of the potentiometer 16 of the aforementioned regulating device.

In this way, any inclination of the gantry 6 on one side or the other of the neutral switch-back position of the feeler 25 has the effect of shifting the zero of the potentiometer 16 in the same direction by an amount proportional to the said inclination. As this angular shift is always in the same direction as the angular displacement of the wiper 35 of the potentiometer 16 (FIG. 2) caused by the descending movement of the tool holder 3, the amplitude of this descending movement is therefore increased by an amount corresponding to the said shift.

As the difference E is a function of the degree of inclination of the gantry 6, the lever arms of the movable members of this correction device will be determined on basis of the mathematical relationship between these two magnitudes so as to obtain correction values which are as close as possible to the difference values E, with due consideration of the transfer function of the movement transmission mechanism applicable here.

Figure 7:
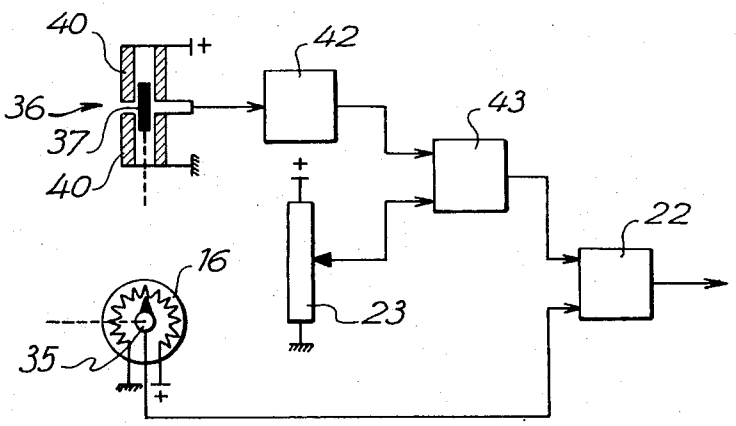
FIG. 7 is a block diagram referring thereto.
Figure 6:
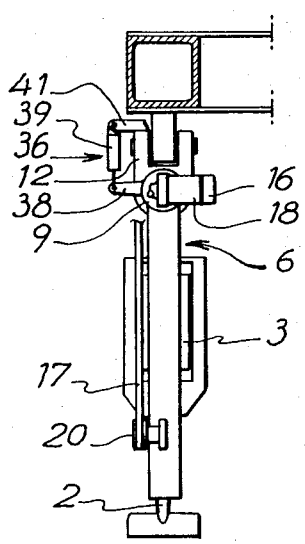
FIG. 6 is a partial side view of the second embodiment.

In the second embodiment, shown in FIGS. 6 and 7, the correction device permits the creation of correction values equal to those of the differences in depth of penetration E of the tamping tools caused by the transverse inclination of the tamping unit.

Elements which are unchanged as compared with the first embodiment which has just been described bear the same reference numbers and will not be described again. These unchanged elements are essentially those of the mechanical structure of the tamping unit proper, shown in FIG. 1, to which reference is had.

In this second embodiment, the housing of the potentiometer 16 of the device regulating the amplitude of the movement of descent of the tool holder 3 is immobilized by attachment to the output disc of the reducer 18. The drive of its wiper 35 is unchanged.

The member for the detection of the angular displacement of the gantry 6 is in this case a linear pick-up 36 whose core 37 is driven by a lever 38 fastened on the cross member 9 of the gantry 6 and whose body 39, having two coils 40, is suspended from a support 41 fastened on an element of the yoke 12 arranged on top of the bearing in which the said cross member 9 is rotatably mounted.

The connection established between this detector 36 and the device for regulating the descending movement of the tool holder 3 is formed of an electronic correction circuit, shown in FIG. 7, in combination with the rotary potentiometer 16 and the constituent elements of the said regulating device which have been previously described, namely the setting member 23 and the comparator 22 which causes the giving off of the switch signal.

This electronic correction circuit comprises a calculating and signal conversion unit 42 and a second comparator 43.

The calculaing and signal conversion unit 42 is programmed and arranged to produce directly an output signal representative of the actual magnitude of the difference E which is a function of the inclination of the gantry detected by the detector 36 on basis of the mathematical function connecting these two magnitudes. This unit 42 is connected, on the one hand to the linear detector 36 and, on the other hand, to an input of the comparator 43 in order to transmit the said output signal to it.

The other input of this comparator 43 is connected to the setting member 23 and this comparator is adapted to produce an output signal equal to the sum of its two input signals, that is to say representative of the amplitude of the movement of descent determined by said setting member 23 plus the correction value corresponding to the difference E determined by the calculating and conversion unit 42. This output signal is directed to an input of the comparator 22 whose other input is connected to the rotary potentiometer 16 for detection of the effective position in height of the tool holder 3 in the gantry 6.

The command level for the giving off of the switch signal by the comparator 22 is thus always decreased by an amount equal to the difference E and the depth of penetration of the tools in the ballast remains unchanged, whatever the inclination of the gantry, within the limits of the possible stroke of the tool holder 3 within the gantry 6.

Of course, changes in the selection of the components of the correction device may be made by the use of equivalents which will be adapted to the different types of device for regulating the amplitude of the movement of descent of the tool holder of the inclinable tamping units of the known tamping machines.

In particular, when this regulating device consists of end-of-stroke switches, they or else their regulating cams can be connected by a mechanical connection to a member for the detection of the inclination of the tamping unit of the mechanical switch-back feeler type of the first embodiment.

What is claimed is:

1. A railway track tamping machine having a rolling chassis adapted to roll on the rails of the railway track and at least one tamping unit mounted on said rolling chassis for tamping the ballast under the sleepers of the railway track, compising in combination:

(a) a gantry integrated in said tamping unit, said gantry being articulated to the rolling chassis;

(b) means for inclining said gantry with respect to the rolling chassis;

(c) a tool holder mounted in said gantry, said tool holder being movable upwardly and downwardly within said gantry;

(d) at least two oscillating and pivoting tamping tools mounted in opposition on said tool holder;

(e) motor means for causing the downward movement of the tool holder in the gantry and penetration of the tamping tools into the ballast;

(f) downward movement adjusting means for limiting said downward movement of the tool holder at a selected value, said downward movement adjusting means being connected to said motor means;

(g) a displacement detector associated to said gantry and tool holder, said displacement detector controlling said downward movement adjusting means;

(h) movable means for defining a zero position for said displacement detector;

(i) a mechanical feeler with neutral switchback position, said mechanical feeler having a first portion articulated to the gantry and a second portion in contact with the rolling chassis; and (j) a transmission rod having one end connected to said mechanical feeler and the other end connected to said movable means, whereby the zero position of the displacement detector is automatically modified upon changes in the inclination of the gantry with respect to the rolling chassis.

2. A railway track tamping machine having a rolling chassis adapted to roll on the rails of the railway track and at least one tamping unit mounted on said rolling chassis for tamping the ballast under the sleepers of the railway track, comprising in combination:

(a) a gantry integrated in said tamping unit, said gantry being articulated to the rolling chassis;

(b) means for inclining said gantry with respect to the rolling chassis;

(c) a tool holder mounted in said gantry, said tool holder being movable upwardly and downwardly within said gantry;

(d) at least two oscillating and pivoting tamping tools mounted in opposition on said tool holder;

(e) motor means for causing the downward movement of the tool holder in the gantry and penetration of the tamping tools into the ballast;

(f) adjusting means for limiting the downward movement of the tool holder at a selected value;

(g) a first comparator connected to said motor means;

(h) a displacement detector associated to said gantry and tool holder, said displacement detector being connected to said first comparator;

(i) an angular displacement electronic feeler having a first element associated with said gantry and a second element associated to the rolling chassis;

(j) calculating unit means connected to said angular displacement electronic feeler for outputting a signal representative of the penetration difference of the tamping tools into the ballast as a function of the inclination of the gantry with respect to the rolling chassis; and (k) a second comparator connected on the one hand to said calculating unit means and adjusting means and on the other hand to said first comparator, whereby the ballast penetration of the tamping tools with respect to the railway track upon which rolls the rolling chassis remains unchanged upon changes in the inclination of the gantry with respect to the rolling chassis.

* * * * *